US006869627B2

(12) United States Patent
Perkovic et al.

(10) Patent No.: US 6,869,627 B2
(45) Date of Patent: Mar. 22, 2005

(54) PRE-MEASURED PORTION PACKAGED FOR PRODUCING A BREWED BEVERAGE

(75) Inventors: Josip Perkovic, Minden (DE); Andreas Sachtleben, Minden (DE); Florian Rohde, Achim (DE)

(73) Assignee: Melitta Haushaltsprodukte GmbH & Co. Kommanditgesellschaft, Minden (DE)

( * ) Notice: Subject to any disclaimer, the term of this patent is extended or adjusted under 35 U.S.C. 154(b) by 240 days.

(21) Appl. No.: 10/036,484

(22) Filed: Jan. 7, 2002

(65) Prior Publication Data

US 2002/0088807 A1 Jul. 11, 2002

(30) Foreign Application Priority Data

Jan. 5, 2001 (DE) ..... 201 00 166 U

(51) Int. Cl.[7] ..... B65B 29/02; B65D 85/804

(52) U.S. Cl. ..... 426/77; 426/112; 426/433; 99/279; 99/295; 206/0.5

(58) Field of Search ..... 426/77, 79, 81, 426/82, 112, 115, 431–433, 435; 99/295, 279, 316, 321; 206/0.5; 210/493.1, 493.5, 497.01, 497.3

(56) References Cited

U.S. PATENT DOCUMENTS

| | | | | | |
|---|---|---|---|---|---|
| 3,445,237 | A | * | 5/1969 | Gidge | 426/77 |
| 3,822,013 | A | * | 7/1974 | Van Der Veken | 206/0.5 |
| 3,823,656 | A | * | 7/1974 | Vander Veken | 99/295 |
| 4,211,156 | A | * | 7/1980 | Zimmermann | 99/287 |
| 4,550,024 | A | | 10/1985 | le Granse | |
| 5,472,719 | A | * | 12/1995 | Favre | 426/77 |
| 6,007,853 | A | | 12/1999 | Lesser | |
| 6,103,116 | A | * | 8/2000 | Koslow et al. | 210/282 |
| 2002/0035928 | A1 | * | 3/2002 | Kataoka | 99/279 |

FOREIGN PATENT DOCUMENTS

| | | | | |
|---|---|---|---|---|
| CH | A 495 138 | | 8/1970 | |
| CH | A 527 592 | | 9/1972 | |
| DE | 3504441 | A1 * | 8/1986 | A47J/31/06 |
| DE | G 86 19 012.1 | | 4/1988 | |
| DE | 690 28 628 | T2 | 1/1992 | |
| EP | 0 211 511 | A1 | 2/1987 | |
| EP | A 0631948 | | 1/1995 | |
| EP | A 0756844 | | 2/1997 | |
| GB | 2 023 086 | A | 12/1979 | |

* cited by examiner

*Primary Examiner*—Milton I. Cano
*Assistant Examiner*—Robert A. Madsen
(74) *Attorney, Agent, or Firm*—Venable LLP; Robert Kinberg

(57) ABSTRACT

A pre-measured portion package for preparing a brewed beverage having a container for being filled with a pre-measured portion of an aroma carrier. The container has a circumferential side wall, a bottom, and a lid. The side wall and the bottom are formed of a single piece of material that is water permeable and capable of filtering; at least the side-wall is compacted to be water impermeable; at least a section of the bottom is water permeable and functions as a filter. The lid is also formed of a material that is water permeable and capable of filtering, is compacted in its circumferential edge region to be water impermeable, and is connected to an upper edge of the side wall to form a seal.

9 Claims, 2 Drawing Sheets

PRE-MEASURED PORTION PACKAGED FOR PRODUCING A BREWED BEVERAGE

CROSS REFERENCE TO RELATED APPLICATION

This application claims the priority of German Patent Application No. DE 201 00 166.7, filed Jan. 5, 2001, the subject matter of which is incorporated herein by reference.

BACKGROUND OF THE INVENTION

The present invention relates to a pre-measured portion package for producing a brewed beverage, comprising a container or receptacle filled with an aroma carrier such as coffee or tea. The container consists of a circumferential side wall, a bottom and a lid, wherein the lid is water-permeable, at least in some sections, and the bottom is designed at least in sections as a filter.

Pre-measured portion packages of the above type are known per se. The known pre-measured portion packages, through which the brewing water flows solely due to gravity, are produced from different materials that are in part water permeable and in part not water permeable and have a relatively complex design.

Furthermore known are pre-measured portion packages for preparing a brewed beverage, for which pressure is required to force the brewing water through the pre-measured portion package. These pre-measured portion packages have the disadvantage that they can be used only in combination with correspondingly designed brewing equipment.

It is the object of the present invention to create an easy to produce and cheap pre-measured portion package for preparing a brewed beverage using gravity.

SUMMARY OF THE INVENTION

The above object generally is solved according to the invention by using a deep-drawing method to form the side wall and the bottom as one piece from a plastic non-woven material, e.g., a plastic fiber mat, or plastic/paper blend or composite capable of filtering. At least the side-wall area is compacted enough to be water-impermeable while the lid is also produced from a plastic non-woven material or plastic/paper blend capable of filtering and is dense enough in the circumferential edge region to be water impermeable. The lid is joined to the upper edge of the side wall, such that it seals tightly.

A pre-measured portion package of this type is produced only with a single starting material, namely a plastic non-woven material or plastic/paper blend capable of filtering, and has a relatively simple design. The pre-measured portion package consists of two individual parts, namely a pot-shaped lower part, forming the bottom and side wall, and a lid closing off the lower part of the package.

The deep-drawing technique is used to produce the lower part of the plastic non-woven material or plastic/paper blend capable of filtering in a single operational step. The lower part is compacted in the side-wall area such that this side-wall area becomes water impermeable. At the same time, the side-wall area is stabilized as a result of the compacting, thus making the complete pre-measured portion package easy to handle.

The lid is also manufactured from a plastic non-woven material or plastic/paper blend capable of filtering, wherein only the circumferential edge region of the lid is compacted such that it becomes water impermeable. After filling the bottom part with an aroma carrier, the lid is fitted onto the lower part and connected to it such that it seals, which can be done thermally.

The use of a plastic/paper blend is advantageous, particularly from an ecological point of view, since this material contains primarily renewable raw material (cell material).

On the whole, a pre-measured portion package according to the invention can be produced extremely cheaply and is highly suitable for practical use since the brewing water for leaching out the aroma carrier flows only as a result of gravity through the pre-measured portion package. No special brewing equipment is therefore required when using this pre-measured portion package. Additional features and/or modifications of the invention are disclosed and discussed.

One exemplary embodiment of the invention is shown in the attached drawings and is described in further detail below.

DETAILED DESCRIPTION OF THE PREFERRED EMBODIMENT

Figure 1:
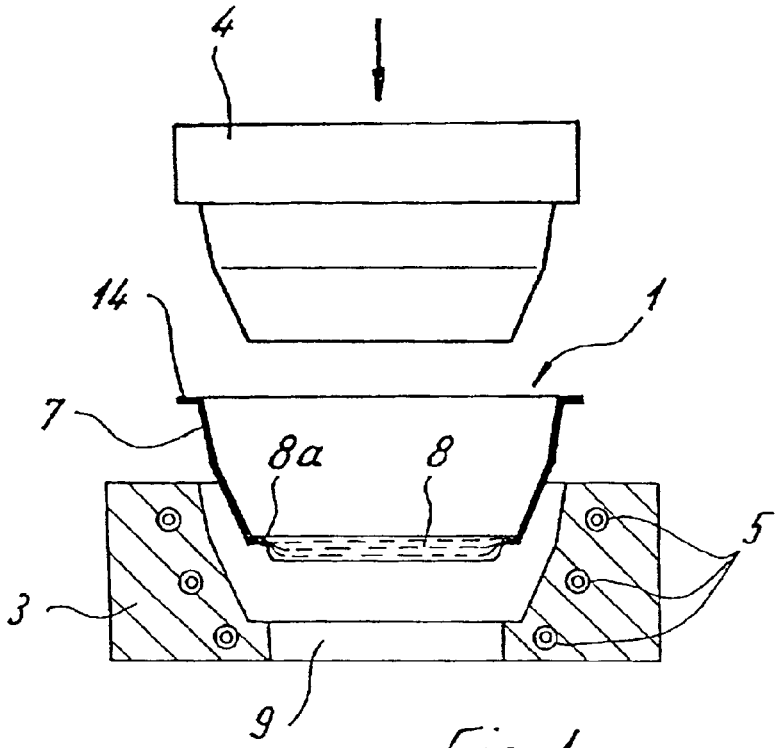
FIG. 1 is a cross section through a lower part for a pre-measured portion package according to the invention, as well as through a tool for producing a lower part of this type.

FIG. 1 shows a schematic sectional view of a deep-drawing tool for producing a lower part 1 of a pre-measured portion package 2 for preparing a brewed beverage. The deep-drawing tool comprises a bottom die 3 and a top die 4, wherein at least the bottom die 3 is provided with a heater 5.

The lower part 1 of a pre-measured portion package 2 according to the invention is produced in this tool.

Figure 2:
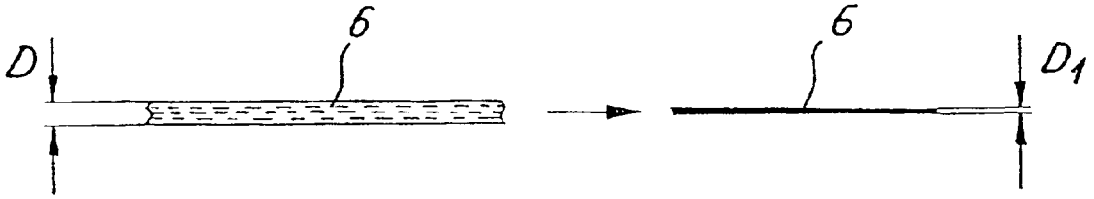
FIG. 2 is a schematic illustration showing a size comparison between the starting material for producing the lower part before and after compacting in the tool according to FIG. 1.

The starting material for producing the lower part 1 is a plastic non-woven material 6, e.g., a plastic fiber mat, that is water permissible and is capable of filtering, with a predetermined material thickness D (see FIG. 2). Alternatively, a plastic/paper blend, composite or mixture can also be used.

According to FIG. 1, the lower part 1 is formed in the tool by using the deep-drawing technique for producing a respective material section made from this plastic non-woven material 6. The lower part consists of a circumferential side wall 7 and a bottom 8. Thus, the two portions 7 and 8 of the lower package part 1 are produced as one piece, i.e., a unitary structure from the same piece of material, and the side-wall area of this lower part 1 is compacted during the production such that at least the complete side-wall area becomes water impermeable. The exemplary embodiment shows a strongly deformed, compacted ring-shaped area 8*a* of bottom 8, which adjoins the side wall 7. On the other hand, the major portion of the bottom 8 is practically not deformed at all and retains its filtering characteristics because the bottom die is provided with a corresponding recess 9.

FIG. 2 clearly shows that the plastic non-woven material 6 is compacted to a material thickness of D1, which amounts to only a fraction of the original material thickness D.

As a result of the enormous compacting under the effect of supplied heat and the pressure from top die 4, the compacted regions (side wall 7 and bottom edge region 8*a*) on the one hand become water impermeable and, on the other hand, obtain a mostly stable form.

Figure 3:
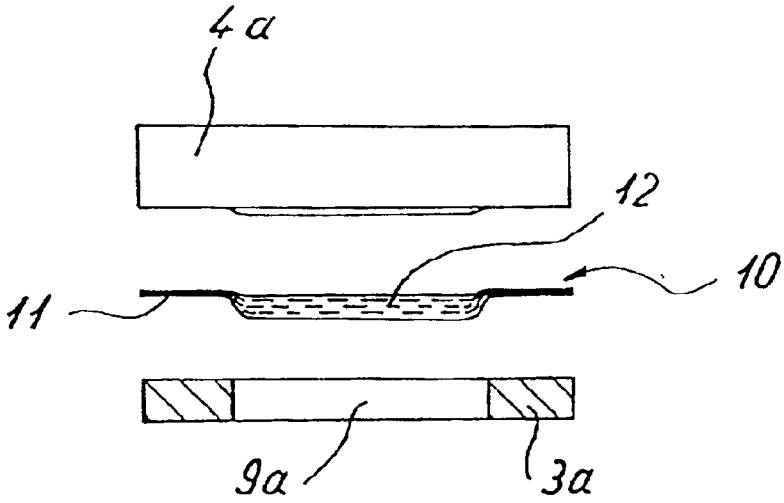
FIG. 3 is a cross-sectional view through the lid of a pre-measured portion package according to the invention, essentially corresponding to FIG. 1, as well as through a tool for producing this lid.
Figure 4:
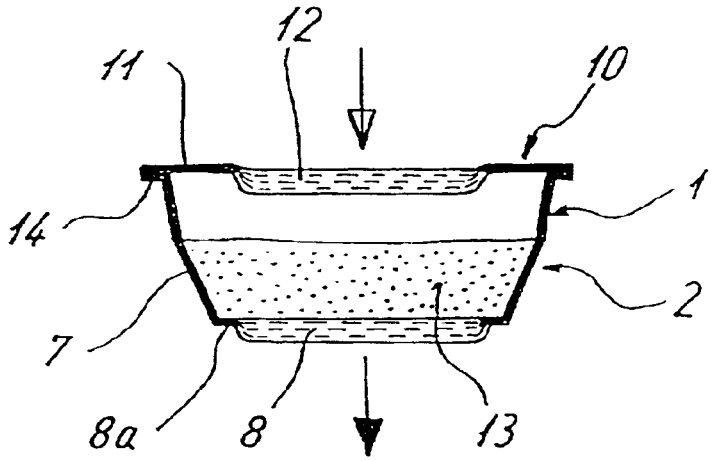
FIG. 4 is a cross section through a complete pre-measured portion package according to the present invention.

FIG. 3 shows that a lid 10, which is also produced from the plastic non-woven material 6 or plastic/paper composite material, is produced inside a bottom die 3*a* with the aid of a top die 4*a*. In the process, only the circumferential edge region 11 of lid 10 is compacted to become water impermeable, whereas the center region 12 of the lid 10 remains practically without deformation and thus water permeable because of the recess 9*a* in the bottom die 3*a*.

Following completion of the lower part 1, this part is filled with an aroma carrier 13, e.g., coffee or tea. The lower part 1 is subsequently closed off with the lid 10. For this, the lid 10 advantageously rests on a outwardly directed circumferential flange 14 that forms the upper edge of the lower part 1, and the lid 10 is thermally welded to this circumferential flange 14, thus tightly sealing the lower part 1.

Brewing water for preparing a brewed beverage thus can flow through the practically non-deformed area 12 of the lid 10 and into the pre-measured portion package 2. As a result of gravity, this brewing water saturates the aroma carrier 13 as well as the bottom 8 region capable of filtering. Since the side wall 7 of the container, consisting of lower part 1 and lid 10, is practically water impermeable, brewing water cannot exit the container in an uncontrolled and undesirable manner. Rather, the brewing water must flow completely through the aroma carrier 13.

The pre-measured portion package can be produced easily and cheaply in the manner as described in the above and is highly suitable for practical use since no special equipment is required for it use.

A polymer plastic non-woven material 6 is preferably used for producing the pre-measured portion package 2 since this material is particularly suitable for the production under the effect of heat and pressure and also permits an easy thermal fusing of lower part 1 and the lid 10.

The invention now being fully described, it will be apparent to one of ordinary skill in the art that many changes and modifications can be made thereto without departing from the spirit or scope of the invention as set forth herein.

What is claimed is:

1. A pre-measured portion package for preparing a brewed beverage from an aroma carrier comprising a container filled with a pre-measured portion of the aroma carrier, said container comprising a circumferential side wall, a bottom, and a lid, wherein the circumferential side wall and the bottom are formed of a single piece of material that is water permeable for filtering, at least the side-wall is compacted to be water impermeable, and at least a section of the bottom is water permeable and functions as a filter, wherein the lid is formed of a material that is water permeable for filtering, is compacted in its circumferential edge region to be water impermeable, and is connected to an upper edge of the side wall to form a seal.

2. A pre-measured portion package according to claim 1, wherein the upper edge of the side wall has an outwardly directed circumferential flange on which the lid rests, and to which the lid is connected to provide the seal.

3. A pre-measured portion package according to claim 2, wherein the material from which the side wall, the bottom, and the lid are formed is a plastic non-woven material.

4. A pre-measured portion package according to claim 1, wherein the material from which the side wall, the bottom, and the lid are formed is a plastic non-woven material.

5. A pre-measured portion package according to claim 1, wherein the lid is fused to the upper edge of the side wall.

6. A pre-measured portion package according to claim 1, wherein a circumferential edge region of the bottom and the side wall are compacted to be water impermeable.

7. A pre-measured portion package according to claim 1, wherein the side wall and the bottom are formed from the material that is a plastic/paper composite material.

8. A pre-measured portion package according to claim 1, wherein the material from which the side wall, the bottom, and the lid are formed is a plastic/paper blend.

9. A pre-measured portion package according to claim 1, wherein the circumferential side wall and the bottom are formed of a single piece of material by a deep-drawing technique.

* * * * *